US005547257A

United States Patent [19]

Lavender

[11] Patent Number: 5,547,257

[45] Date of Patent: Aug. 20, 1996

[54] RETRACTABLE ARMREST

[75] Inventor: Donald C. Lavender, Hickory Corners, Mich.

[73] Assignee: GDS Seating, Inc., Fountain Inn, S.C.

[21] Appl. No.: 96,126

[22] Filed: Jul. 22, 1993

[51] Int. Cl.[6] ..... A47C 7/54

[52] U.S. Cl. ..... 297/411.32; 297/411.3; 297/248; 16/348; 16/357

[58] Field of Search ..... 297/411.32, 411.3, 297/411.45, 248, 357, 115; 16/348, 357

[56] References Cited

U.S. PATENT DOCUMENTS

| | | | |
|---|---|---|---|
| 1,845,025 | 2/1932 | Konzelman | 297/357 |
| 3,402,962 | 9/1968 | Ellis et al. | 297/357 X |
| 3,880,466 | 4/1975 | Brennan | 297/411.32 |
| 4,322,111 | 3/1982 | Barley | 297/357 |
| 4,657,305 | 4/1987 | Meiller | 297/115 X |
| 4,850,159 | 7/1989 | Conner | 297/248 X |
| 5,116,102 | 5/1995 | Chaundy | 297/357 |

FOREIGN PATENT DOCUMENTS

| | | | |
|---|---|---|---|
| 25688 | 1/1923 | France | 297/357 |
| 1146368 | 5/1957 | France | 297/357 |
| 851113 | 1/1952 | Germany | 297/357 |
| 3110515 | 11/1982 | Germany | 297/411.32 |
| 314690 | 2/1934 | Italy | 297/357 |
| 2064642 | 6/1981 | United Kingdom | 16/348 |

*Primary Examiner*—Peter M. Cuomo
*Assistant Examiner*—David E. Allred
*Attorney, Agent, or Firm*—Baker & McKenzie

[57] ABSTRACT

An armrest for a stadium chair. The armrest is connected to a stanchion by a bolt which extends through a slotted oblong lug carried by the armrest. The lug and armrest cooperate with a lobular bearing surface in the stanchion. The lug fits into lobes of the bearing surface in such a way as to retain the armrest in a raised position and a lowered retracted position. Movement of the armrest from the raised position requires a user to first lift the armrest without rotating, and then rotate the armrest to the lowered position. A polymeric bearing plate held between the armrest and the stanchion acts as a guide keeping the movement of the armrest in a single plane.

7 Claims, 3 Drawing Sheets

Fig. 1.
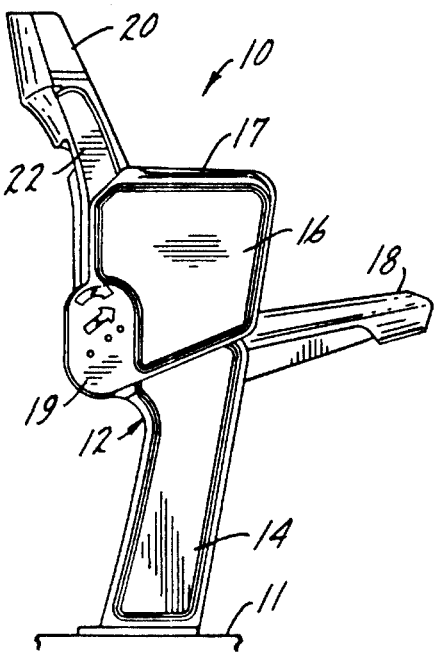
Fig. 2.
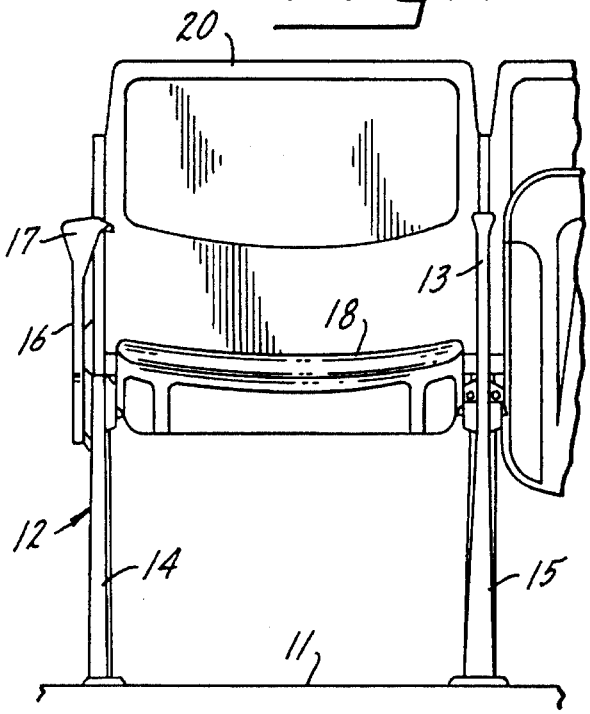
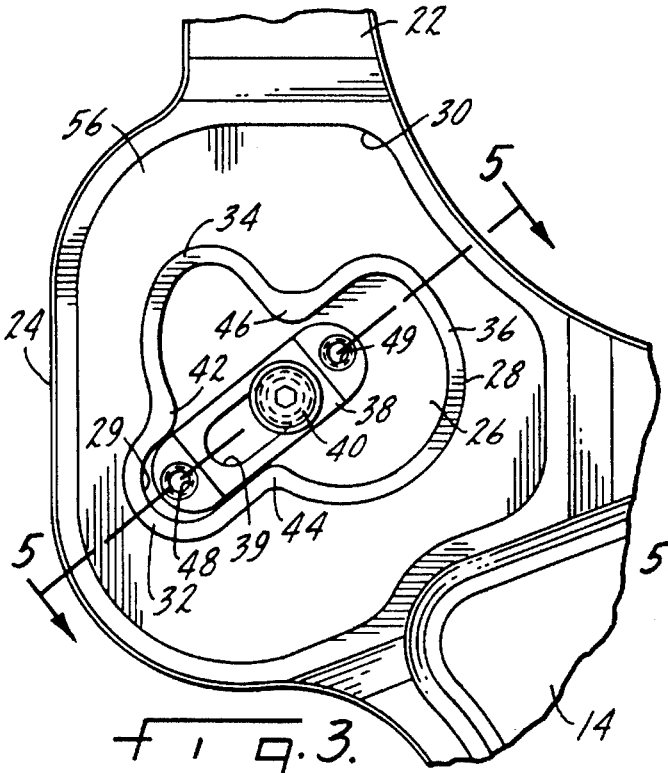
Fig. 3.
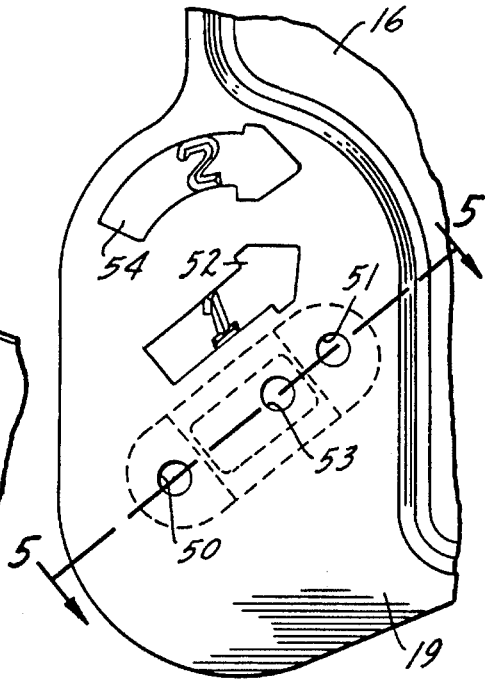
Fig. 4.

RETRACTABLE ARMREST

BACKGROUND AND SUMMARY OF THE INVENTION

The present invention relates to public seating, and in particular to stadium chairs with moveable armrests.

In recent years, architects and designers become increasingly aware of the need to accommodate individuals with physical disabilities. One of the motivating factors for this increased awareness was the passage of legislation known as the Americans with Disabilities Act (ADA). Such legislation requires that new buildings and equipment, and some existing facilities, be made to allow disabled persons to use and have access to public areas such as public seating. As a result of this legislation and the general awareness of the need to provide access to disabled persons, new designs of buildings and equipment have proliferated.

One of the barriers to disabled persons in facilities such as stadiums is the armrest on stadium seating. Rigid and fixed armrests on typical stadium seating make it difficult for some disabled persons to maneuver themselves into position to occupy seats. The difficulties are compounded by the close row-to-row spacing of stadium seating and the relatively small width of stadium seats, which configurations are required to maximize the capacity of stadiums.

One of the objects of the present invention is to provide a seating arrangement in which the end seat in a row has an armrest that can be easily moved to a retracted position in which the armrest does not impede or otherwise limit access to that seat.

Another object of the present invention is to provide a seating arrangement in which the side support of the end seat in a row is shaped to allow increased access thereto by a disabled person.

Still another object of the present invention is to provide a retractable armrest which is of a simple and cost-effective design.

Still another object of the present invention is to provide an arrangement with a retractable armrest in which the armrest is economical to manufacture and durable.

These and other objects and advantages of the present invention are achieved with a seating arrangement in which a main seat support or stanchion is provided with a pivoting armrest. The stanchion includes a recess in its side into which a lug carried by the armrest fits. The recess is configured to engage the lug in such a way that the armrest is movable from a raised position to a retracted position. A bolt extends through the lug and through the stanchion. The armrest is guided by a bearing plate as the armrest rotates about the bolt in a plane which is generally perpendicular to the ground. The recess in the stanchion includes various lobular recesses and abutments which control and limit pivoting and translational movement of the armrest.

The objects and advantages of the present invention will be better understood upon a reading of the following specification read in conjunction with the following drawings.

BRIEF DESCRIPTION OF THE DRAWINGS

FIG. 1 is a side elvational view of a seat having a retractable armrest in accordance with the present invention.

FIG. 2 is a front elevational view of the seat shown in FIG. 1.

FIG. 3 is an enlarged side view of the connection between the armrest and the main support of the seat of the present invention.

FIG. 4 is a side view of the outside of the armrest of the present invention.

DETAILED DESCRIPTION OF THE INVENTION

Figures 5, 6:
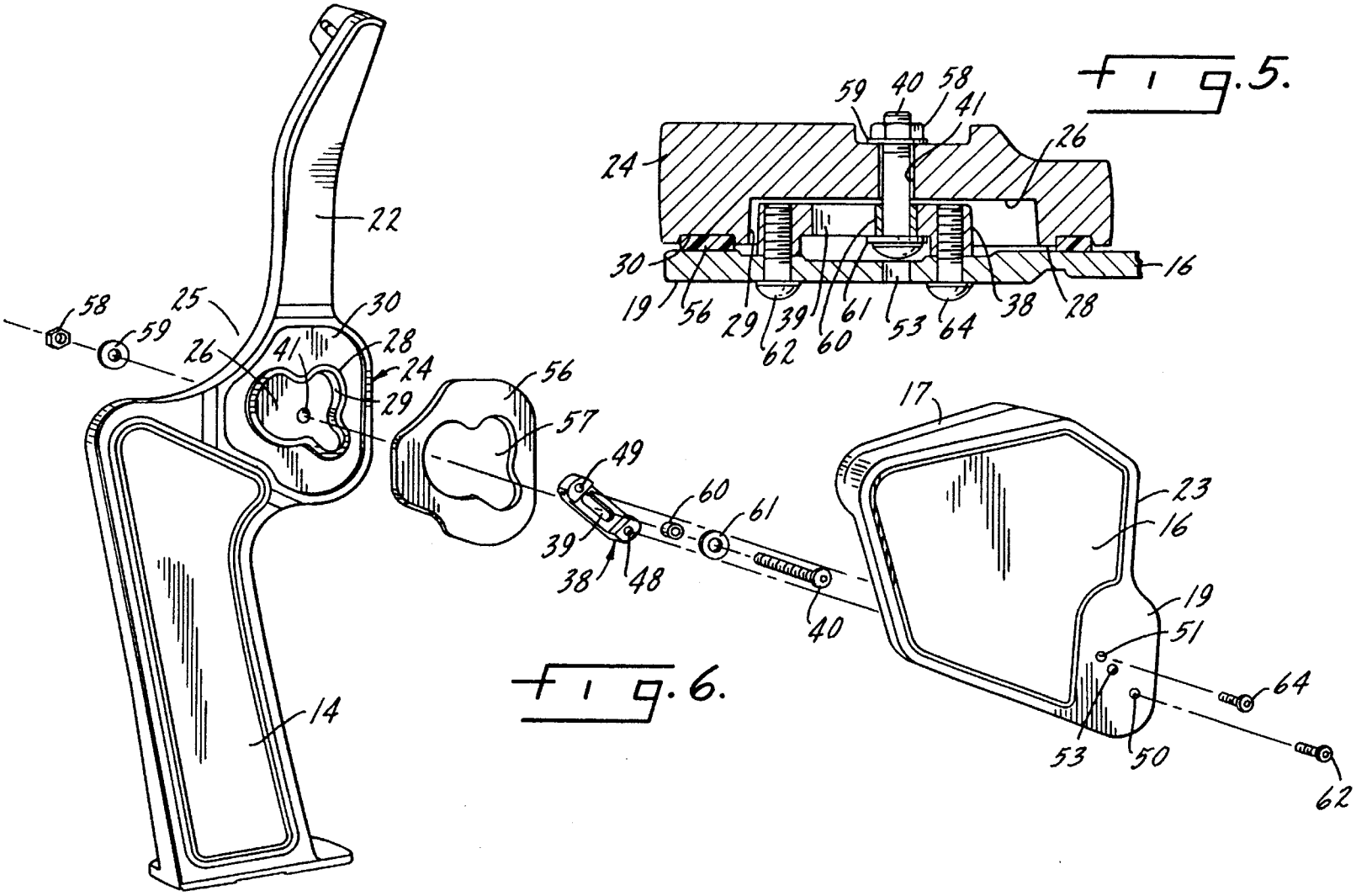
FIG. 5 is a sectional view taken along lines 5—5 of FIGS. 3 and 4.
FIG. 6 is an exploded view of the support and armrest of the present invention.

FIG. 1 shows the stadium chair 10 of the present invention which is comprised of a stanchion 12 to which is attached a movable armrest 16. Also attached to the stanchion 12 is a seat 18 and a back 20. The stanchion 12 is comprised of a base 14 which is connected to a horizontal support 11, and an upper part 22 to which the back 20 is attached. The armrest 16 has a widened arm support area 17 and a connection area 19. The connection area 19 of the armrest 16 is connected to the central part 24 of the stanchion 12.

A seat having an armrest of the present invention is designed for use as part of the end unit of a row of stadium chairs, as can be seen in FIG. 2. The movable armrest 16 of the present invention is attached to the outer stanchion of the end unit in a row of stadium chairs. A standard stanchion 15 with a fixed armrest 13 may be used between adjacent units in the row of the stadium chairs. It should also be noted that, while a stanchion shown herein is intended to be attached to a horizontal support 11, the armrest arrangement of the present invention is clearly adaptable for use with riser-mounted seating in which a stanchion base is attached to a vertical support. The only required structural difference between a floor- (horizontal) mounted system and a riser- (vertical) mounted system is the orientation and shape of the lower portion of the stanchion base.

FIGS. 3 and 4 are enlarged views of the central part 24 of the stanchion 12 of the present invention, and the connection area 19 of the armrest 16 of the present invention. FIG. 3 shows a rib 28 formed as an integral part of the central part 24 of the stanchion 12. The rib 28 circumscribes an inner recess 26. An outer recess 30 surrounds the rib 28. An oblong lug 38 includes a slot 39 through which a bolt 40 extends, allowing the lug to move within the recess 26. A bearing plate 56 (shown in FIGS. 5 and 6) is shaped to fit within the outer recess 30.

The rib 28 and the recess 26 are generally tri-lobular in shape. A first lobe 32 is bounded by a first abutment 42 and a second abutment 44. A second lobe 34 is bounded by the first abutment 42 and a third abutment 46. The third lobe 36 is bounded by the second and third abutments, 44 and 46, respectively. The inside surface of the rib 28 generally defines a bearing surface 29 which contacts the lug 38 when the armrest 16 is in its usable (or raised) and retracted (or lowered) positions, which positions are clearly shown in FIGS. 7 and 10 respectively. The bearing surface 29 forms a closed loop to provide an endless bearing surface strip which surrounds the lug 38 when the armrest 16 is assembled to the stanchion 12.

FIGS. 5 and 6 show the manner by which the armrest 16 is attached to the stanchion 12. The bolt 40 is used to hold the lug 38 in the recess 26 and the bolt 40 extends through the washer 61, the sleeve 60 and the slot 39, and continues through an opening 41 in the central part 24 of the stanchion. A grip nut 58 and washer 59 are fastened to the unheaded end of the bolt 40 on the inner side of the stanchion 12. The bearing plate 56 is placed into the outer recess 30 of the central part 24 of the stanchion 12. The bearing plate has a central opening 57 which is shaped to fit closely around the rib 28. The armrest 16 is attached to the lug 38 by screws 62 and 64. The screws 62 and 64 extend through openings 50 and 51, respectively, in the connection area 19 of the armrest 16, and threadingly engage tapped holes 48 and 49 formed in raised ends of the lug 38.

To facilitate movement of the lug 38 around the bolt 40, the sleeve 60 should be dimensioned to fit loosely between the underside of the head 40 and the area of the stanchion surrounding the opening 41 in order to allow the sleeve to rotate or roll about the bolt 40. Because the head of the bolt 40 is not tightened against the sleeve 60 or the lug 38, a grip nut 58 should be used in connection with the bolt 40 when fastening the lug 38 into the recess 26. Grip nuts such as those that have a plastic insert carried by the nut, or those which have flexible inwardly directed fingers are suitable for use with the present invention.

After the armrest 16 has been attached to the lug 38 by the screws 62 and 64, the pressure exerted by the connection area 19 of the armrest 16 against the bearing plate 56 should be adjusted to a snug condition by rotating the bolt 40. This adjustment can be accomplished by extending an appropriate tool through the access opening 53 in the connection area 19 of the armrest 16 and engaging the recess (which may be an Allen, Torx, Phillips, slotted, etc.) in the head of the bolt. However, in making the adjustment to the pressure exerted on the bearing plate 56, it will be necessary to either hold the grip nut 58 from rotating while tightening the bolt 40 through the access hole 53, similarly, or, holding the bolt while rotating the nut.

Figure 10:
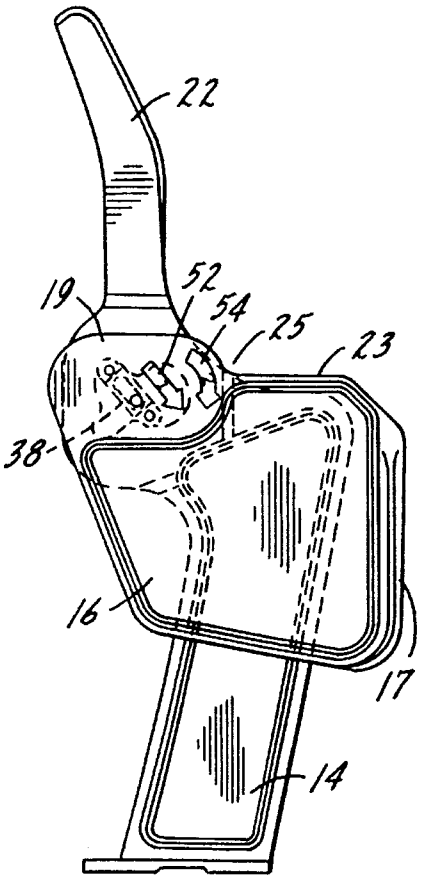
FIGS. 7 through 10 are a series of the side elevational views showing the manner in which the armrest of the present invention moves from one position to the other.
Figure 7:
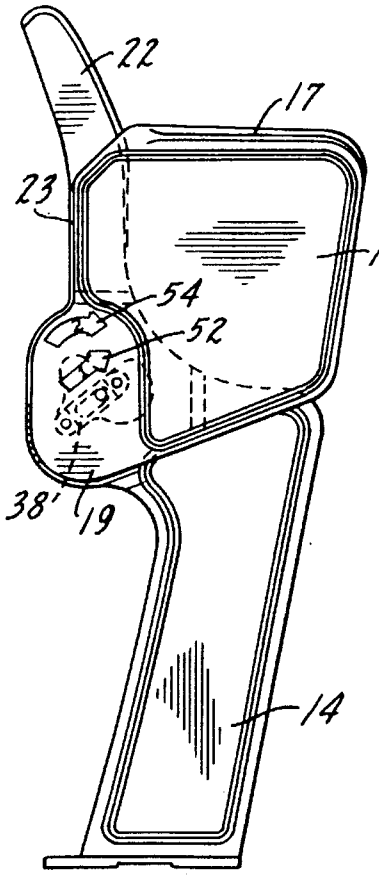

Once the armrest 16 of the present invention has been assembled to a stanchion of the present invention as shown in FIG. 6, the armrest will be capable of moving from the raised position as shown in FIG. 7 to the lowered position as shown in FIG. 10. The instructional arrows 52 and 54 provide step-by-step instruction regarding the movements required to lower the armrest 16 from its raised position. To move the armrest from the raised position it is first necessary to lift the armrest 16 so that the lug 38 moves out of the portion of the recess 30 defined by the first lobe 32. Doing so allows rotation of the armrest downward in accordance with the second instructional arrow 54.

Once the armrest is in the lowered position, as shown in FIG. 10, the rear edge 23 of the armrest 16 is in a horizontal position, and the widened arm support area 17 of the armrest 16 is in a generally vertical position. In this lowered position, the lug 38 is within the portion of the recess 30 defined by the second lobe 34. In the lowered position, the third abutment 46 prevents further downward rotation of the armrest 16 beyond the position shown in FIG. 10.

Figure 9:
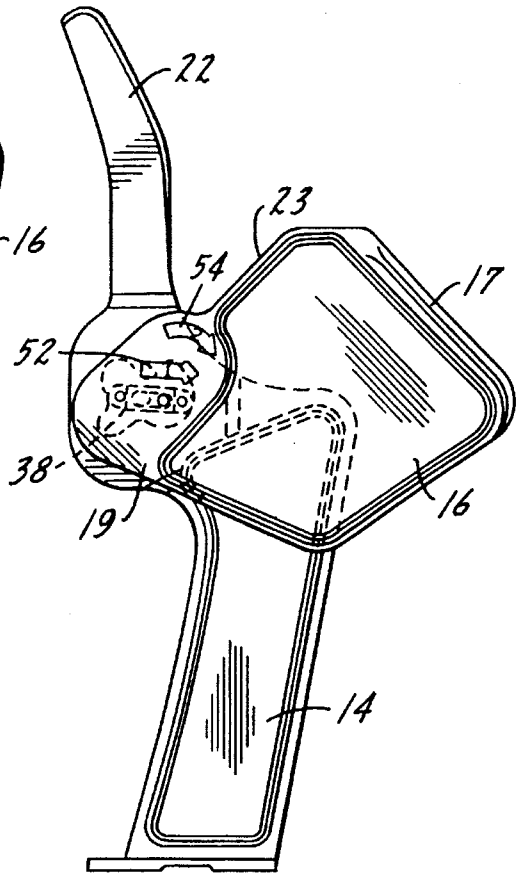
Figure 8:
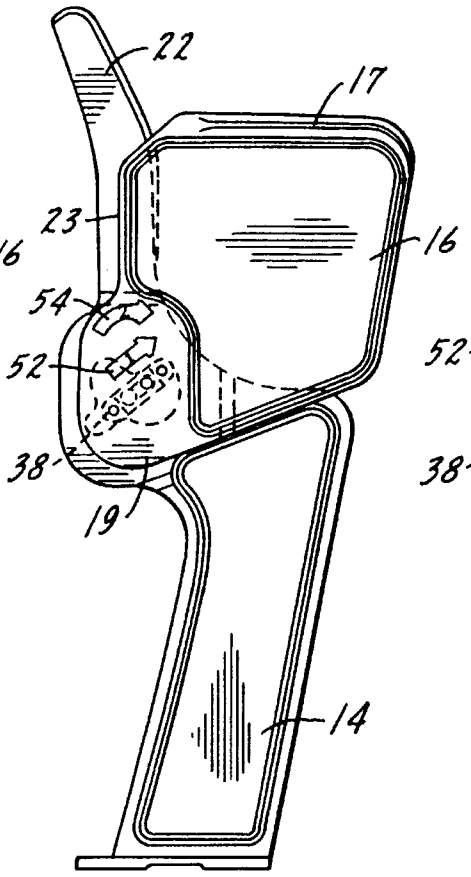

Simple rotation (without translation) of the armrest from the position shown in FIG. 10 to the intermediate position shown in FIGS. 9 and 8 respectively, followed by an angled lowering of the armrest into the position of FIG. 7 will return the armrest to its raised position. When in the raised position, the armrest 16 is prevented from rotation in either clockwise or counter-clockwise rotation because rotation of the lug 38 is prevented by the first and second abutments, 42 and 44. The second and third abutments prevent unintended rotation of the armrest from its raised position until the armrest is lifted in the direction of the first instructional arrow 52, a translational movement without rotation.

The stanchion 12 and the armrest 16 of the present invention are shaped to allow a handicapped person to have ready access to the end seat of a row of stadium chairs. To facilitate access to the end seat, the stanchion 12 is provided with an open area 25 between the upper part 22 of the stanchion and the stanchion base 14. The central part 24 of the stanchion to which the armrest is attached is set back from the front of the stanchion base 14 so that the legs of a user may be freely swung approximately 90 degrees while the user is in a seated position. Similarly, the armrest 16 has a rear edge 23 which is offset with respect to the connection area 19 of the armrest 16. Therefore, in the lowered position, as shown in FIG. 10, the rear edge of the armrest is at a height which is approximately equal to the portion of the seat 18 which is immediately adjacent to the armrest 16. By allowing a user to rotate his or her body approximately 90 degrees, i.e., from a position facing forward to a position facing sideways, the stadium chair of the present invention allows a person having limited use of his or her legs greater accessibility to the end seat of a row of stadium chairs.

The stanchion and armrest of the present invention are preferably made of a sand-cast strontium-modified aluminum alloy. Since the stadium chair of the present invention is designed for use in outdoor applications, the castings which comprise the stanchion and armrest components should be self-draining, i.e., there should be no locations where rain water or other liquids can accumulate. The bearing plate 56, which guides the rotation of the armrest keeping its translational and rotational movement substantially planar, is preferably made of nylon. However, other materials such as ultra-high molecular weight polyethylene may be used. The lug 38 is preferably made of an investment cast stainless steel, and the fasteners used to hold the various components of the stadium chair of the present invention together are preferably made of stainless steel.

While the invention has been described with respect to a preferred embodiment, persons skilled in the art may make modifications, variations and improvements to the embodiment described herein without departing from the spirit and scope of the invention.

I claim:

1. A stadium chair comprising an armrest mounted to a main seat support which in includes a seat back, said armrest being movable relative to said seat back to two positions, a first of said two positions being one in which said armrest provides an arm support surface for an occupant of said seating device and prevents lateral sliding by an occupant from said chair, a second of said two positions being one in which said armrest is retracted and allows an occupant to exit from said seat laterally, said main seat support having an internal bearing surface, and said armrest carrying a non-circular lug, said lug having an opening, a fastener extending through said opening and holding said lug in proximity to said bearing surface, said lug being fixed to said armrest, said bearing surface surrounding said lug with an endless bearing surface strip defining at least two lobes, wherein one of said lobes is for receiving an end of said lug and holding said armrest in said first position and a second one of said lobes receiving an end of said lug and holding said armest in said second position, said bearing surface having a plurality of abutments adjacent to a first one of said lobes for contacting said lug to restrict rotational movement of said armrest when one end of said lug is within said first lobe, whereby said lug is slidably lifted together with said armrest from said first position out of engagement with said first one of said lobes and is rotatably brought into engagement with said second one of said lobes in said second position.

2. A seating device in accordance with claim 1 wherein said bearing surface includes at least one abutment for contacting said lug to limit downward rotation of said armrest.

3. A seating device in accordance with claim 1 wherein said armrest undergoes planar movement when moving from said first to said second positions.

4. A seating device in accordance with claim 1 wherein a bearing plate for guiding movement of said armrest is held between said armrest and said main seat support, said bearing plate being disposed in a recess in said main seat support.

5. A seating device in accordance with claim 4 wherein pressure on said bearing plate exerted by said armrest and said main seat support is adjustable.

6. A seating device in accordance with claim 5 wherein adjustment of said pressure on said bearing plate is achieved by a threaded connection between said armrest and said main seat support, said threaded connection comprising a bolt and nut combination, said nut including means for gripping said bolt to prevent loosening of the connection between said bolt and said nut despite lack of axial tension in said bolt.

7. A seating device in accordance with claim 6 wherein said armrest contains instructional indicia which indicate to a user the steps required to move said armrest from one position to another.

* * * * *